US010006598B2

(12) United States Patent
Sekido et al.

(10) Patent No.: US 10,006,598 B2
(45) **Date of Patent: *Jun. 26, 2018**

(54) DAYLIGHTING SYSTEM

(71) Applicant: Dai Nippon Printing Co., Ltd., Tokyo (JP)

(72) Inventors: Masayuki Sekido, Tokyo (JP); Satoshi Mitsuzuka, Tokyo (JP); Tomoe Takanokura, Tokyo (JP); Chiaki Obata, Tokyo (JP); Saya Amemiya, Tokyo (JP); Michiya Suzuki, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/639,208

(22) Filed: Jun. 30, 2017

(65) Prior Publication Data

US 2017/0299135 A1 Oct. 19, 2017

Related U.S. Application Data

(63) Continuation of application No. 14/897,871, filed as application No. PCT/JP2014/065910 on Jun. 16, 2014, now Pat. No. 9,719,644.

(30) Foreign Application Priority Data

Jun. 14, 2013 (JP) ..... 2013-125243

(51) Int. Cl.
*F21S 11/00* (2006.01)
*E06B 9/28* (2006.01)
(Continued)

(52) U.S. Cl.
CPC ..... *F21S 11/007* (2013.01); *E06B 9/01* (2013.01); *E06B 9/28* (2013.01); *F21V 9/04* (2013.01); *E06B 2009/2417* (2013.01)

(58) Field of Classification Search
CPC .. F21S 11/007; E06B 5/00; E06B 2009/2417; G02B 5/00; G02B 5/02; G02B 17/006; G02B 2207/123
(Continued)

(56) References Cited

U.S. PATENT DOCUMENTS 9,366,403 B2 6/2016 Kashiwagi et al.
2011/0043919 A1 2/2011 Ko et al.
(Continued)

FOREIGN PATENT DOCUMENTS

JP 58-128299 U 8/1983
JP 11-036739 A1 2/1999
(Continued)

OTHER PUBLICATIONS

International Search Report (Application No. PCT/JP2014/065910) dated Aug. 12, 2014 (with English translation).
(Continued)

*Primary Examiner* — Christopher Mahoney
(74) *Attorney, Agent, or Firm* — Burr & Brown, PLLC

(57) ABSTRACT

A daylighting system includes a sheet-like light control member disposed on at least an upper part of a daylighting opening, and a shade disposed oppositely to at least a part of the opening, the part being below the part where the light control member is disposed. The light control member is configured to change upward a traveling direction of incident light and allow the incident light to pass through the light control member.

7 Claims, 5 Drawing Sheets

(51) Int. Cl.

| | |
|---|---|
| ***F21V 9/04*** | (2018.01) |
| ***E06B 9/01*** | (2006.01) |
| *E06B 9/24* | (2006.01) |

(58) Field of Classification Search
USPC ..... 359/596, 598
See application file for complete search history.

(56) References Cited

U.S. PATENT DOCUMENTS

| | | | |
|---|---|---|---|
| 2014/0104689 | A1 | 4/2014 | Padiyath et al. |
| 2016/0223155 | A1 | 8/2016 | Nango et al. |
| 2016/0252225 | A1 | 9/2016 | Tsujimoto et al. |

FOREIGN PATENT DOCUMENTS

| | | | |
|---|---|---|---|
| JP | 2001-003661 | A1 | 1/2001 |
| JP | 2006-222011 | A1 | 8/2006 |
| JP | 2009-266794 | A1 | 11/2009 |
| JP | 2013-037995 | A1 | 2/2013 |
| JP | 2013-062157 | A1 | 4/2013 |
| WO | 2012/017509 | A1 | 2/2012 |

OTHER PUBLICATIONS

International Preliminary Report on Patentability (Application No. PCT/JP2014/065910) dated Dec. 23, 2015.
Japanese Office Action (Application No. 2013-125243) dated Feb. 14, 2017 (with English translation).
Japanese Office Action (Application No. 2017-118983) dated Mar. 27, 2018 (with English translation).

DAYLIGHTING SYSTEM

CROSS REFERENCE TO RELATED APPLICATIONS

This application is a continuation of U.S. application Ser. No. 14/897,871, filed Mar. 1, 2016, which in turn is the National Stage of International Application No. PCT/JP2014/065910, filed Jun. 16, 2014, the entireties of which are incorporated herein by reference.

FIELD OF THE INVENTION

The present disclosure relates to a daylighting system to be installed on a periphery of a daylighting opening. In particular, the present disclosure relates to a daylighting system capable of exerting an excellent daylighting function (in other words "letting-in-light function" or "improving-lighting function"), without disfiguring the periphery of the daylighting opening.

BACKGROUND OF THE INVENTION

As disclosed in JP2006-222011A, for example, the use of sunlight as illumination light has been under review. In the invention disclosed in JP2006-222011A, a light shelf is disposed oppositely to an upper part of a daylighting opening, and a shade (in other words "blind") is disposed below the light shelf. By adjusting an inclination angle of the light shelf, the light shelf throws upward sunlight entering a room from the upper part of the daylighting opening. Namely, the light shelf offers a light shielding function in terms of anti-glare effect, while simultaneously offering a daylighting function for daylighting an upper space inside the room (for letting in light to the upper space inside the room). Since the shade is disposed below the light shelf, the shade can exert a function expected to be offered by the shade, such as the light shielding function, without impairing the daylighting function of the light shelf.

In the invention disclosed in JP2006-222011A, the light shelf conspicuously extends into the room with a view to sufficiently achieving the light shielding function and the daylighting function. Thus, the light shelf brings a feeling of strangeness without going together a surrounding area, which seriously disfigures the periphery of the opening. For this reason, the light shelf is not actually in widespread use. On the other hand, if a system capable of offering an excellent daylighting function without disfiguring the periphery of the opening can be realized, the use of a lighting apparatus can be restrained through the prevalence of this system, whereby energy can be saved and $CO_2$ can be reduced.

The present invention has been made in view of the above circumstances. One object of the present invention is to provide a daylighting system capable of exerting an excellent daylighting function, without disfiguring a periphery of an opening.

SUMMARY OF THE INVENTION

In some embodiments the daylighting system is a daylighting system comprising:

a sheet-like light control member disposed on at least an upper part of a daylighting opening, the light control member being configured to change upward a traveling direction of incident light and allow the incident light to pass therethrough; and a shade disposed oppositely to at least a part of the opening, the part being below the part where the light control member is disposed.

DETAILED DESCRIPTION OF THE INVENTION

Figure 1:
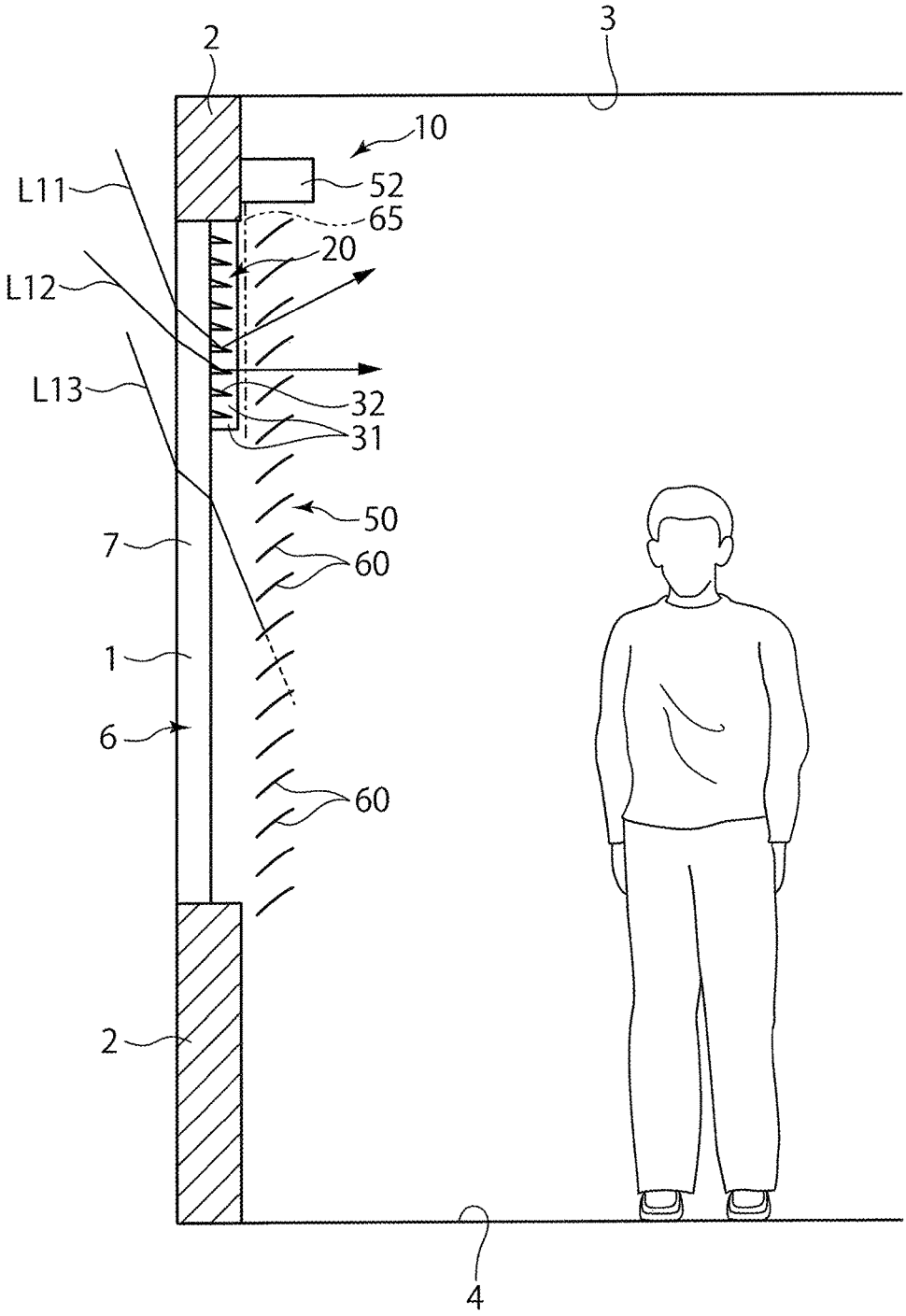
FIG. 1 is a side view of a daylighting system, for explaining an embodiment of the present invention.

Some embodiments of the present invention will be described herebelow with reference to the drawings. The embodiments include a daylighting system, an object, a window and a method of manufacturing a daylighting system. Exemplary embodiments of the present invention are described herein. It should be noted that these exemplary embodiments are merely examples and the present invention is not limited to the detailed embodiments. In the drawings attached to the specification, a scale size, an aspect ratio and so on are changed and exaggerated from the actual ones, for the convenience of easiness in illustration and understanding.

In this specification, terms specifying shapes, geometric conditions and their degrees, e.g., "parallel", "perpendicular", "same", etc., are not limited to their strict definitions, but construed to include a range capable of exerting a similar function.

Further, in this specification, the terms "sheet", "film" and "plate" are not differentiated from one another, based only on the difference of terms. For example, the "sheet" is a concept including a member that can be referred to as film or plate.

Furthermore, the term "sheet plane (film plane, plate plane)" means a plane corresponding to a plane of a sheet-like (film-like plate-like) member as a target, when the sheet-like (film-like, plate-like) member as a target is seen as a whole in general. A normal line to the sheet-like (film-like, plate-like) member means a direction normal to the sheet plane (film plane, plate plane) of the sheet-like (film-like, plate-like) member.

Still furthermore, an "up and down direction" in this specification is a direction not in parallel with a horizontal direction in a plane in parallel with a vertical direction, and does not always correspond to the vertical direction. The term "up (upper, above, upward)" means one side (or part) in the up and down direction, i.e., a side (or part) adjacent to the "up" in the vertical direction. The term "down (lower, below, downward)" is a side opposed to the "up" in the up and down direction, i.e., a side (or part) adjacent to the "down" in the vertical direction.

Figure 2:
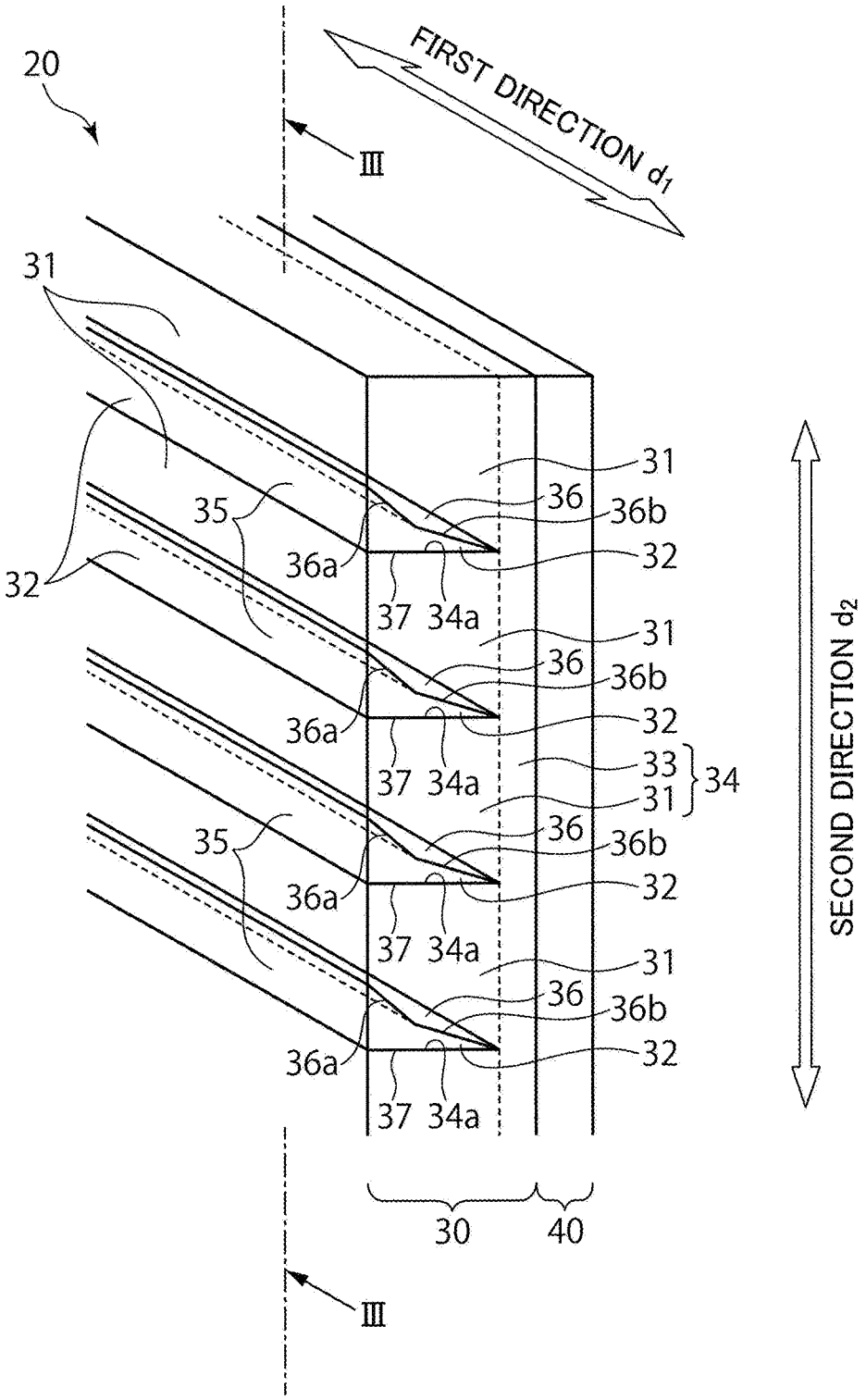
FIG. 2 is a partial perspective view of a light control member of the daylighting system.
Figure 3:
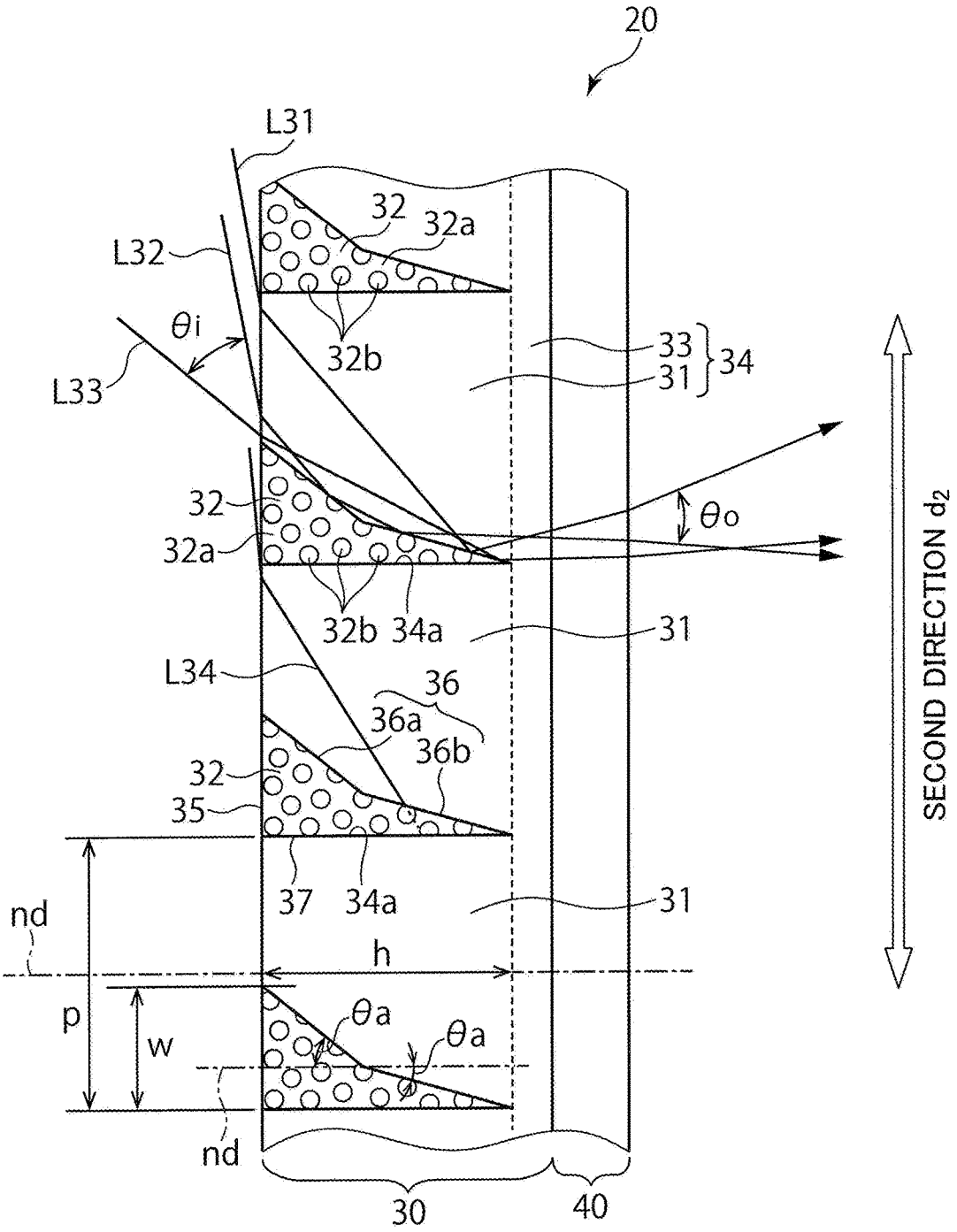
FIG. 3 is a sectional view taken along the line III-III of FIG. 2.
Figure 4:
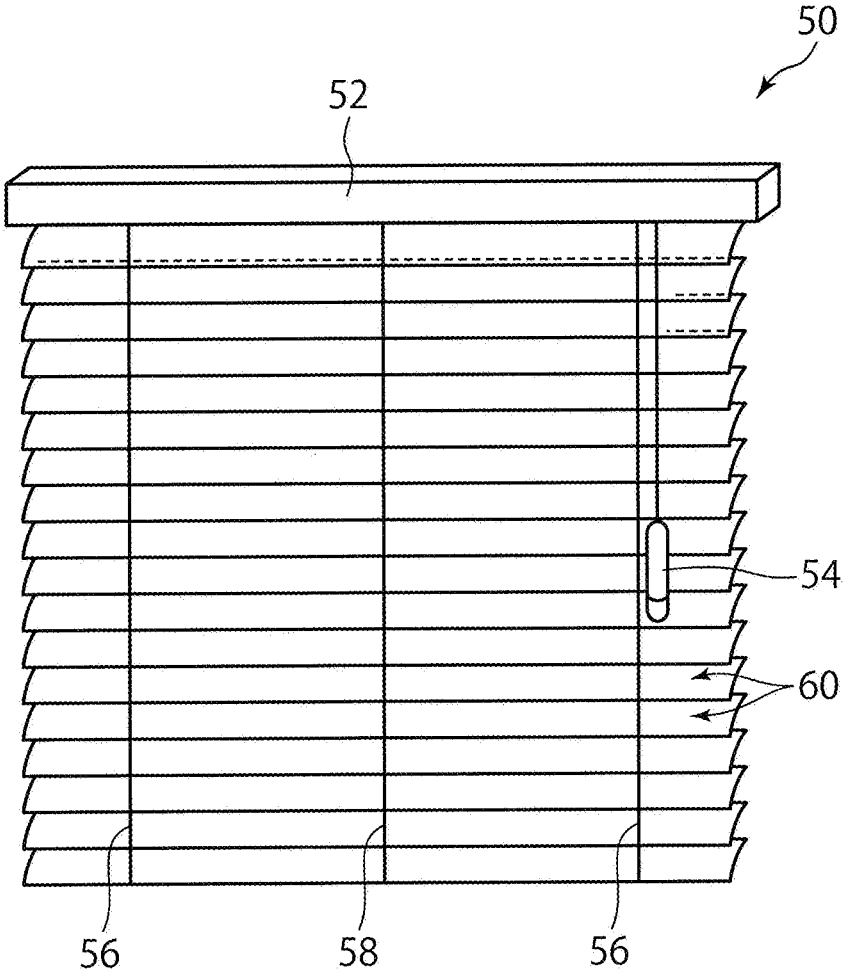
FIG. 4 is a perspective view of a shade of the daylighting system.

FIGS. 1 to 4 are views for explaining an embodiment of the present invention. FIG. 1 is a side view showing a daylighting system. FIGS. 2 and 3 are respectively a perspective view and a vertical sectional view of a light control member of the daylighting system. FIG. 4 is a perspective view showing a shade of the daylighting system.

The below-described daylighting system 10 is an apparatus to be installed on a periphery of a daylighting opening 1, which is a system for efficiently letting in sunlight. The daylighting system 10 includes a light control member 20 disposed on at least an upper part of the daylighting opening 1, and a shade (in other words, blind) 50 disposed oppositely to at least a part of the opening 1, the part being below the part where the light control member 20 is disposed. The light control member 20 is formed to have a sheet-like shape, as a member extending in a planar direction. As shown in FIG. 1, the light control member 20 allows incident light to transmit therethrough such that a traveling direction of the incident light is changed upward. As described in more detail below, the daylighting system 10 explained herein can exert a sufficient daylighting function, while exerting an anti-glare function by efficiently preventing entry of direct light of the sunlight through the opening. In addition, since the daylighting system 10 is not provided with any projection that projects to an area to be daylighted by the daylighting system 10, the periphery of the opening 1 is not disfigured or impaired in terms of unified fashion.

In the example described below, the daylighting system 10 is applied to a daylighting window of a building. The opening 1 is formed in a wall 2. The shade 50 is installed in a room partitioned by the wall 2, a ceiling 3 and a floor 4. The shade 50 is mounted on the wall 2 to face the daylighting opening 1 formed in the wall 2. A daylighting implement 6, which includes a transparent window member 7 made of glass or the like, is fitted in the opening 1, so that the opening 1 is closed by the daylighting implement 6. The light control member 20 is attached to the window member 7 or sandwiched and supported between a pair of window members 7, such that the light control member 20 forms, together with the window member(s) 7, the daylighting implement 6, or that the light control member 20 forms, as a part of the window member(s) 7, the daylighting implement 6.

The light control member 20 is described firstly. In the example shown in FIG. 1, the light control member 20 is attached to an upper part of the daylighting implement 6. As shown in FIG. 2, the light control member 20 includes first portions 31 and second portions 32 each of which linearly extends in a first direction d1 that is in parallel with a sheet plane of the light control member 20. The first direction d1 extends in parallel with the sheet plane of the light control member 20, and is not in parallel with the up and down direction, as shown in FIG. 1. In addition, as shown in FIG. 2, the first portion 31 and the second portion 32 are alternately arranged in a second direction d2 that is not in parallel with the first direction d1. The second direction d2 extends in parallel with the sheet plane of the light control member 20. In the illustrated example, the second direction d2 is in parallel with the up and down direction.

Particularly in the illustrated example, the window member 7 extends in parallel with the vertical direction. As a result, the sheet plane of the light control member 20 is in parallel with the vertical direction. In addition, the first direction d1 and the second direction d2 are perpendicular to each other. Thus, in the illustrated example, the first direction d1 extends horizontally, while the second direction d2 extends vertically.

As shown in FIGS. 2 and 3, the light control member 20 includes a light control layer 30 having the first portions 31 and the second portions 32, and a substrate layer 40 laminated on the light control layer 30. In this embodiment, although the substrate layer 40 is provided because of a manufacturing method of the light control layer 30, which will be described later, the substrate layer 40 is not an essentially indispensable element. Thus, for example, the substrate layer 40 may be formed of a mere transparent or translucent resin film.

On the other hand, the light control layer 30 further has, in addition to the first portions 31 and the second portions 32, a sheet-like base portion (land part) 33 that supports the first portions 31 and the second portions 32. The base portion 33 is integrally formed with the first portion 31 so as to form a light control layer body 34 together with the first portion 31. In other words, the light control layer 30 of the light control member 20 includes the light control layer body 34 having grooves 34*a* formed therein, and the second portions 32 respectively formed in the grooves 34*a* of the light control layer body 34. A portion between the adjacent grooves 34*a* of the light control layer body 34 defines the first portion 31.

FIG. 3 shows a main section of the light control member 20, i.e., the section being in parallel both with the second direction d2 which is the arrangement direction of the first portions 31 and the second portions 32, and with a normal direction nd to the sheet plane of the light control member 20. As shown in FIG. 3, the second portion 32 includes a bottom surface 35 partially forming a surface of the light control layer 30, the surface being opposed to the side of the substrate layer 40, a first side surface 36 extending from the bottom surface 35, and a second side surface 37 extending from the bottom surface 35. In the illustrated example, the first side surface 36 and the second side surface 37 gradually come close to each other along the normal direction to the sheet plane of the light control member 20, as they go away from the bottom surface 35, and finally connect to each other. In the illustrated example, the second side surface 37 is formed as a flat surface, while the first side surface 36 is formed as a polygonal surface. Particularly in the illustrated example, the first side surface 36 includes a steeply inclined surface 36*a* connected to the bottom surface 35, and a mildly inclined surface 36*b* located on a side away from the bottom surface 35 to be connected to the second side surface 37. An angle defined by the steeply inclined surface 36*a* relative to the normal direction nd to the sheet plane of the light control member 20 is larger than an angle defined by the mildly inclined surface 36*b* relative to the normal direction nd to the sheet plane of the light control member 20.

The first side surface 36 of each second portion 32 forms an interface between the second portion 32 and the first portion 31 adjacent to the second portion 32 from the upper side in the up and down direction. On the other hand, the second side surface 37 of each second portion 32 forms an interface between the second portion 32 and the first portion 31 adjacent to the second portion 32 from the lower side in the up and down direction. From a viewpoint of deflecting and letting in incident light from a wide angular range into a narrower angular range, the interface between each second portion and the first portion 31 adjacent to the second portion 32 from above, i.e., the first side surface 36 of the second portion 32 is inclined relative to the normal direction nd to the light control member 20, such that the first side surface 36 is positioned upward in the up and down direction on the incident side, and is positioned downward in the up and down direction on the outgoing side. In addition, from the viewpoint of deflecting and letting in incident light into a narrower angular range, as in the example shown in FIG. 3, it is preferable that, in the plane shown in FIG. 3 along both the normal direction nd to the light control member 20 and the second direction d2 which is the arrangement direction of the first and second portions 31, 32, an angle $\theta_a$ (see FIG. 3), which is defined by the interface between each second portion and the first portion adjacent to the second portion 32 from above, relative to the normal direction nd to the light control member 20, varies to decrease from the incident side toward the outgoing side.

The fact that the angle $\theta_a$ "varies to decrease from the incident side toward the outgoing side" means not only that the angle $\theta_a$ continuously decreases, but also that the angle $\theta_a$ degreases stepwise, as in the example shown in FIG. 3. The terms "incident side" and "outgoing side" are used pursuant to a light path along which the sunlight is let in. Thus, in FIGS. 1 and 3, the left side corresponds to the incident side, while the right side corresponds to the outgoing side.

In the illustrated example, the second portions 32 are arranged at equal intervals therebetween along the second direction d2. In addition, the second portions 32 extend in the first direction d1 with sections thereof being unchanged. Further, the second portions 32 included in the light control member 20 are identical to one another in structure. Due to the aforementioned structure of the second portions 32, in the illustrated example, the first portions 31 included in the light control member 20 are arranged at equal intervals therebetween along the second direction d2, extend in the first direction d1 with sections thereof being unchanged, and are identical to one another in structure.

In the section shown in FIG. 3, an arrangement pitch p of the second portions 32 along the second direction d2 may be 1 mm or less, for example, and a height h of the second portion 32 along the normal direction nd to the sheet plane of the light control member 20 may be 1 mm or less. A thickness of the light control member 20 along the normal direction nd to the sheet plane of the light control member 20 may be not less than 300μ and not more than 2 mm.

A ratio of the height h of the second portion 32 along the normal direction nd to the sheet plane of the light control member 20 relative to the width w of the second portion 32 along the sheet plane of the light control member 20, that is to say, an aspect ratio represented as h/w is preferably greater than 1, and more preferably 5 or more, in order to sufficiently exert the daylighting function and another function such as the light shielding function and so on. In addition, the aspect ratio is preferably 10 or less, in consideration stability in manufacture.

Note that the aforementioned structures of the first portions 31 and the second portions 32 are mere examples, and their structures can be suitably modified in consideration of, e.g., a below-described function of the light control member 20. For example, the first side surface 36 of the second portion 32 may be formed as a curved surface. Also when the first side surface is a curved surface, it is preferable that the angle $\theta_a$ (see FIG. 3), which is defined by the interface between each second portion 32 and the first portion 31 adjacent to the second portion 32 from above, relative to the normal direction nd to the light control member 20, varies to decrease from the incident side toward the outgoing side, as described above. In addition, the sectional shape of the second portion 32 may be variously modified, e.g., into a trapezoidal shape. Moreover, the first portions 31 included in the light control member 20 may differ in shape and/or arrangement. Similarly, the second portions 32 included in the light control member 20 may differ in shape and/or arrangement.

Next, materials of the first portion 31 and the second portion 32 are explained.

The first portion 31 is formed to be transparent. In this specification, the term "transparent" means that a visible light transmittance is 50% or more. However, the visible light transmittance of the first portion 31 in this embodiment is preferably 70% or more, and more preferably 90% or more.

The visible light transmittance in this specification is determined as follows. A 1-μm thick film of a material forming a part to be measured is deposited on a PET film manufactured by TOYOBO Co., Ltd. (product number: Cosmo Shine A4300, thickness: 100 μm). Then, by using a spectrophotometer (manufactured by Shimadzu Corporation, "UV-2450", compliant with JISK0115), transmittances of the part are measured with measurement wavelength range of from 380 nm to 780 nm. An average value of the transmittances at the respective wavelengths is the visible light transmittance. Similarly, a heat ray transmittance described later is determined as follows. A 1-μm thick film of a material forming a part to be measured is deposited on a PET film manufactured by TOYOBO Co., Ltd. (product number: Cosmo Shine A4300, thickness: 100 μm). Then, by using a spectrophotometer (manufactured by Shimadzu Corporation, "UV-2450", compliant with JISK0115), transmittances of the part are measured with measurement wavelength range of from 900 nm to 2500 nm. An average value of the transmittances at the respective wavelengths is the heat ray transmittance.

In addition, in this embodiment, the base portion 33 is integrally formed with the first portion 31 by using the same material as that of the first portion 31. As a material for use in the light control layer body 34 forming the first portion 31 and the base portion 33, there may be used a resin material, in particular, a cured material of an ionizing radiation curing resin which cures by irradiation of an ionizing radiation, for example. As the ionizing radiation curing resin, an ultraviolet curing resin, an electron radiation curing resin, a visible light curing resin, a near-infrared radiation curing resin may be taken for instance. A concrete example of the resin material may be an acrylic resin.

On the other hand, the second portion 32 has a refractive index different from that of the first portion 31. In this embodiment, the second portion 32 includes a main portion 32*a* functioning as a binder, and an optional functional content 32*b* dispersed in the main portion 32*a*. The refractive index of the main portion 32*a* is different from the refractive index of the first portion 31. As a result, an interface between first portion 31 and the second portion 32 has a refractive index difference so as to function as a surface that reflects visible light. In order that the visible light coming from the side of the first portion 31 is reflected on the interface between the first portion 31 and the second portion 32, the refractive index of the second portion 32 is preferably adjusted to be smaller than the refractive index of the first portion 31.

As a material for use in the main portion 32*a* of the second portion 32, there may be used a resin material, in particular, a cured material of an ionizing radiation curing resin which cures by irradiation of an ionizing radiation, for example. As the ionizing radiation curing resin, an ultraviolet curing resin, an electron radiation curing resin, a visible light curing resin, a near-infrared radiation curing resin may be taken for instance. A concrete example of the resin material may be an acrylic resin having a refractive index different from that of the acrylic resin for use in the first portion 31. However, in a case where the second portion 32 includes the functional content 32*b*, the same acrylic resin as that of the first portion 31 may be used, if the refractive index of the second portion 32 is changed by the functional content 32*b*.

The functional content 32*b* of the second portion 32 is dispersed in the main portion 32*a* with a view to offering various functions. For example, the functional content 32*b* may be a heat absorbing agent or a coloring agent. As the heat absorbing agent, there are used particles having an absorption property for light in a near-infrared light wavelength range, and a transmission property for light in a visible light wavelength range. Specifically, as the heat absorbing agent, inorganic nanoparticles having transparency may be used. For example, there may be used antimony tin oxide (ATO), indium tin oxide (ITO), lanthanum hexaboride ($LaB_6$), aluminum-doped zinc oxide, indium-doped zinc oxide, gallium-doped zinc oxide, tungsten oxide, cerium hexaboride, anhydrous antimony tin oxide, and copper sulfide, or mixture of these nanoparticles.

As the coloring agent, there may be used particles having a function of absorbing at least light of a certain wavelength range within the visible light wavelength band. As an example of the coloring agent, there may be used a pigment, more specifically, a black pigment such as carbon black, graphite, titanium nitride, etc., or a white pigment such as titanium oxide, etc. In addition, bluish particles such as iron blue, blue or violet particles, reddish particles and yellowish particles may be used as the coloring agent. Due to the functional content 32*b* as the cooling agent included in the second portion 32, the second portion 32 can be colored. At this time, a design property can be given to the light control member 20, in consideration of the color quality of the second portion 32 and so on.

The light control layer 30 as structured above may be manufactured in the following manner. The light control layer body 34 forming the first portions 31 and the base portions 33 is manufactured by using a curing material such as epoxy acrylate, which will cure by irradiation of an ionizing radiation such as an electron radiation or an ultraviolet radiation. To be specific, a mold roll having projections corresponding to the structure (position, shape or the like) of the grooves 34*a* of the light control layer body 34, in other words, a mold roll having recesses corresponding to the structure (position, shape or the like) of the first portions 31, is prepared. A sheet for forming the substrate layer 40 is fed between the mold roll and a nip roll. In accordance with the feeding of the sheet, the curing material is supplied between the mold roll and the substrate layer 40. Thereafter, the curing material is pressed by the mold roll and the nip roll, such that the recesses of the mold roll are filled with the uncured, liquid curing material supplied to the substrate layer 40. At this time, the curing material is supplied to the substrate layer 40 such that the curing material is thicker than a depth of each recess of the mold roll, i.e., the mold roll and the substrate layer 40 are not brought into contact with each other, so that the above-described base portion (land part) 33 is formed integrally with the first portions 31 out of the curing material. After the space between the substrate layer 40 and the mold roll is filled with the uncured, liquid curing material, the curing material is irradiated with to cure (solidify) the curing material, whereby the light control layer body 34 can be formed.

Then, the second portions 32 are manufactured by using an uncured liquid composition which includes a curing material which cures to form the main portion 32*a*, and the optional functional content 32*b*. As the curing material which cures to form the main portion 32*a*, there may be used a curing material such as urethane acrylate which cures by an ionizing radiation. Firstly, the composition is supplied to the light control layer body 34 that has been already formed. Thereafter, while the composition is filled into the grooves 34*a* formed between the adjacent first portions 31, i.e., into the portions corresponding to the projections of the mold roll, the superfluous composition overflowing from the grooves 34*a* is scraped by means of a doctor blade. After that, the composition between the first portions 31 is irradiated with an ionizing radiation to cure the composition, so that the second portions 32 are formed. Thus, there is manufactured the light control member 20 including the substrate layer 40, the base portion 33 disposed on the substrate layer 40, and the first portions 31 and the second portions 32 disposed on the base portion 33.

Next, the shade 50 is described.

As shown in FIG. 1, the shade 50 is located to cover not only the area opposed to a part of the opening 1, the part being below a part where the light control member 20 is disposed, but also an area opposed to the light control member 20. Namely, in the illustrated example, the shade 50 is located oppositely to the overall area of the opening 1, and thus can exert a light shielding function, a heat shielding function and so on, against light coming from the overall area of the opening 1. Herebelow, an example of the shade 50 is described, but various known shades may be used in the daylighting system 10 described herein.

As shown in FIG. 4, the shade 50 includes a number of slats 60 that are arranged in an up and down direction, and means for supporting and operating the slats 60. The slats 60 are also referred to as louver boards. Each slat 60 is formed as a thin-plate-like member which is elongated in a direction in nonparallel with the up and down direction. Particularly in the illustrated example, the slats 60 included in the shade 50 are arranged in the vertical direction, and each slat 60 extends horizontally.

The shade 50 includes: an attachment box 52 serving as an attachment tool to the wall 2; a ladder code 56 extending downward from the attachment box 52, the ladder code 56 supporting the slats 60 at vertical intervals; an elevation code 58 for drawing upward the slats 60; and an operation grip 54 connected to the ladder code 56 and the elevation code 58.

In this embodiment, the ladder code 56 controls the inclination of each slat 60 such that all the slats 60 included in the shade 50 are substantially parallel. By operating the ladder code 56 through operation grip 54, the inclination of the slat 60 can be adjusted. On the other hand, by operating the elevation code 58 through the operation grip 54, the slats 60 can be drawn upward in such a manner that the vertical intervals between the slats 60 are sequentially narrowed from below. At this time, the slats 60 are at least partially accommodated in the attachment box 52, so that the daylighting implement 6 mounted on the opening 1 is exposed to the room. Similarly, by operating the elevation code 58 through the operation grip 54, the slats 60 gathered in the upper position can be drawn downward to the position facing the daylighting implement 6. For example, a thin plate member made of an anticorrosive aluminum alloy, a thin plate made of a wooden material or a thin plate made of a resin may be used as the slat 60. Such a slat 60 is opaque and has a visible-light shielding property. The slat 60 may have a function for reflecting visible light to change a traveling direction of incident light. In addition, a surface of the slat 60 may be provided with a functional layer for imparting to the shade 50 a heat shielding function, an antifouling function, an antibacterial function, and a deodorant function. For example, a fluorine coating and/or a titanium oxide coating may be provided to the slat 60.

Note that, in the shade 50 in this embodiment, various known structures can be used as the slat 60, the attachment box 52, the operation grip 54, the ladder code 56, the elevation code 58, and the mechanism for operating the ladder code 56 and the elevation code 58 through the operation grip 54.

Next, an operation of the aforementioned daylighting system 10 is described. Only the shade 50 is disposed in the area where the light control member 20 is not disposed, i.e., in a part excluding the upper part of the opening 1. In this area, various functions that should be intrinsically offered by the shade 50 can be exerted by the shade 50.

Firstly, a sole operation of the shade 50 is explained. By operating the operation grip 54, the inclination of the slats 60, which are arranged at intervals in the up and down direction, can be adjusted at a position facing the daylighting implement 6 mounted on the opening 1. In this embodiment, the thin plate-like slats 60 are arranged such that their plate planes are in parallel with one another. By operating the operation grip 54, the inclinations of all the slats 60 included in the shade 50 can be adjusted.

For example, by operating the operation grip 54, the slat 60 can be inclined relative to both the horizontal direction and the vertical direction, such that the plate plane of each slat 60 is gradually lowered from the incident side toward the outgoing side. In this case, since the plate plane of the slat 60 is substantially in parallel with an incident direction of sunlight into the room through the opening 1, the sunlight can be introduced to the room at high efficiency. As a result, the room can be brightly illuminated by the sunlight. Simultaneously, since the slat 60 is opaque, visibility of the room through opening 1 can be somewhat impaired by the slat 60. Namely, the slat 60 can daylight the room, while making the room not easily visible from the outside.

On the other hand, as shown in FIG. 1, by operating the operation grip 54, the slat 60 can be inclined relative to both the horizontal direction and the vertical direction, such that the plate plane of each slat 60 is gradually raised from the incident side toward the outgoing side. In this case, since the plate plane of the slat 60 is substantially perpendicular to an incident direction of a sunlight beam L13 through the opening 1, the sunlight can be shielded at high efficiency. Thus, the sunlight beam L13 can be prevented from directly entering through the opening 1 the inside of the building provided with the daylighting system 10, i.e., entry of the direct light can be prevented. That is to say, a light shielding function in terms of anti-glare effect is enabled. Simultaneously, since the slat 60 is opaque, visibility of the room through opening 1 can be somewhat impaired by the slat 60. Namely, the slat 60 can daylight the room, while making the room not easily visible from the outside.

As shown in FIG. 1, when the inclination of the slat 60 of the shade 50 is adjusted from the viewpoint of anti-glare effect, a conventional shade that is merely disposed oppositely to the opening 1 darkens the room. The light shielding function for providing anti-glare effect differs in purpose from the light shielding function for making the room dark. Namely, it is often required that the room is brightened while the light shielding function for the anti-glare effect is being carried out. In this case, the brightness in the room has to be backed up by using an indoor lighting apparatus, while the shade 50 exerts the light shielding function in terms of the anti-glare effect.

On the other hand, the lighting system 10 employed herein has the light control member 20 on an upper part of the daylighting implement 6. As shown in FIG. 3, the light control member 20 includes the light control layer 30 having the first portion 31 and the second portion 32 which constitute a reflective index interface. The first direction d1, which is the longitudinal direction of the first portions 31 and the second portions 32, extends in a direction intersecting the up and down direction, particularly in this embodiment, in the horizontal direction. On the other hand, the second direction d2, which is the arrangement direction of the first portions 31 and the second portions 32, extends in the vertical direction in this example. Thus, as shown in FIG. 3, sunlight beams L31, L32, L33, which come diagonally from above toward the opening 1 on which the daylighting implement 6 is mounted, can easily enter the interface between the first portion 31 and the first side surface 36 of the second portion 32 of the light control member 20, and further can reflect on the interface. Since the sunlight beams L31, L32, L33 reflect on the first side surface 36 of the second portion 32, the traveling direction of each sunlight beam is bent upward. In other words, the light incident on the light control member 20 through the first portion 31 then to reach the first side surface 36 of the second portion 32 is thrown upward by the reflection on the first side surface 36.

Herein, the expression "traveling direction is changed or bent upward" means that the traveling direction heretofore is changed or bent to the upper side, and does not necessarily mean that the traveling direction is changed to a traveling direction that is inclined upward relative to the normal direction nd to the light control member 20. In FIG. 3, illustration of the window member 7 of the daylighting implement 6 is omitted.

As shown in FIG. 1, the light whose light path is bent upward by the light control member 20 having the function for changing a light path of sunlight can pass through between the slats 60 of the shade 50, which are inclined such that the plate planes of the slats 60 are gradually raised from the incident side toward the outgoing side. Since the traveling direction of a sunlight beam L11 is thrown upward, the sunlight beam L11 can reach the inside of the room distant from the position at which the window member is installed. Namely, the light control member 20 can change a light path of the sunlight, such that the light path of the sunlight is adapted to the orientation of the slats 60 that are adjusted to exert the light shielding function. Thus, the daylighting system 10 can exert the excellent daylighting function, while simultaneously offering the light shielding function by the shade 50. That is to say, since the daylighting system 10 can satisfy both the light shielding function for an anti-glare effect and the daylighting function for illuminating the room, the use of an indoor lighting apparatus can be restrained, energy can be saved and $CO_2$ can be reduced.

Particularly in the illustrated example, a pair of main surfaces of the light control layer 30, i.e., the incident side surface and the outgoing side surface are in parallel with each other. In addition, as described above, the interface between each second portion 32 and the first portion 31 adjacent to the second portion 32 from above, i.e., the first side surface 36 of the second portion 32 is inclined relative to the normal direction nd to the light control member 20, such that the first side surface 36 is positioned upward in the up and down direction on the incident side, and is positioned downward in the up and down direction on the outgoing side. As a result, a traveling direction of sunlight incident on the light control member 20 from a direction that is largely inclined upward is bent by the reflection on the interface between the first side surface 36 of the second portion 32 and the first portion 31, such that an outgoing angle of the sunlight going out from the light control member 20 is smaller than an incident angle of the sunlight incident on the light control member 20. For this reason, in the plane along both the normal direction nd to the light control member 20 and the second direction d2 which is the arrangement direction of the first and second portions 31, 32, i.e., in the plane as shown in FIG. 3, an angular range $\theta_i$ (see FIG. 3) including the incident direction of the sunlight, which enters the light control member 20 from a direction inclined upward such that the sunlight is reflected on the interface between the first side surface 36 of the second portion 32 and the first portion 31, and is then reflected on the interface between the first side surface 36 of the second portion 32 and the first portion 31, is larger than an angular range $\theta_0$ including the outgoing direction of the sunlight going out from the light control member 20. Namely, the light control member 20 not only changes the traveling direction of the sunlight, but also narrows down the outgoing direction of the sunlight having changed its traveling direction, into a small angular range. As a result, the sunlight beams L11, L12 having transmitted through the light control member 20 can easily pass through between the slats 60 of the shades 50 installed on the outgoing side of the light control member 20, whereby the sunlight can be let in more efficiently.

Further, in the illustrated example, the second portion 32 of the light control member 20 has a reflective index lower than that of the first portion 31. Thus, the light incident on the first portion 31 of the light control member 20 can enter the interface between the first side surface 36 of the second portion 32 and the first portion 31, such that a total reflection condition on the interface therebetween is satisfied. The light control member 20 more significantly enforces the function for narrowing down a traveling direction, on the light incident on the interface such that the total reflection condition on the interface is satisfied. Namely, in the plane along the normal direction nd to the light control member 20 and the second direction d2, it is possible to significantly narrow the angular range $\theta_0$ including the outgoing direction of the light going out from the light control member 20, the light having entered the interface between the first portion 31 and the first side surface 36 of the second portion 32 of the light control layer 30 at an incident angle larger than a total reflection threshold angle, and totally reflected on the interface to transmit through the light control member 20, as compared with the angular range $\theta_i$ including the incident direction of the light incident on the light control member 20. Namely, the total reflected light occupying relatively a larger part of the light transmitting the light control member 20 is narrowed down into a small angular range, whereby the light can pass through between the slats 60 of the shade 50, which achieves a more efficient daylighting function.

In addition, in this embodiment, as shown in FIG. 3, the first side surface 36 of the second portion 32 has the steeply inclined surface 36*a* on the incident side, and the mildly inclined surface 36*b* on the outgoing side. In such a structure, roughly speaking, light that travels in a direction relatively largely inclined relative to a horizontal plane tends to enter the steeply inclined surface 36*a*, while light that travels in a direction not relatively largely inclined relative to the horizontal plane tends to enter the mildly inclined surface 36*b* without entering the steeply inclined surface 36*a*. The steeply inclined surface 36*a* can bend the traveling direction of the light beam L32 coming from the direction steeply inclined relative to the horizontal plane such that the light beam L32 does not stands up too much, so as to effectively guide the light beam to the inside of the room distant from the opening 1. Further, as shown in FIG. 3, the light beam L32 coming from the direction steeply inclined relative to the horizontal plane, which was once reflected on the steeply inclined surface 36*a*, can be again reflected on the mildly inclined surface 36*b* located on the outgoing side. As shown in FIG. 3, the light, which entered from a direction relatively largely inclined relative to the horizontal plane and reflected plural times on the first side surface 36 of the second portion 32, goes out in a direction substantially close to that of the light beam L33 which entered from a direction not relatively largely inclined relative to the horizontal plane and reflected on the mildly inclined surface 36*b* without entering the steeply inclined surface 36*a*.

Namely, as typically shown in the illustrated example, in the plane along both the normal direction nd to the light control member 20 and the second direction d2 which is the arrangement direction of the first and second portions 31, 32, when an angle defined by the interface, which is between each second portion 32 and the first portion 31 adjacent to the second portion 32 from above, relative to the normal direction nd to the light control member 20 varies to decrease from the incident side toward the outgoing side, an outgoing direction of light, which has changed its traveling direction in the light control member 20 and passed therethrough, can be narrowed down into a small angular range. As a result, the light having transmitted through the light control member 20 tends to pass through between the slats 60 of the shade 50 installed on the outgoing side of the light control member 20, which achieves a more efficient daylighting function.

As shown in FIG. 3, the light beam L34, which enters the second portion 32 without reflecting on the interface between the first portion 31 and the second portion 32, is subjected to the action of the functional content 32*b* in the second portion 32. For example, when the functional content 32*b* has a function for absorbing visible light, as shown in FIG. 3, most of visible light of the sunlight beam L34 having entered the second portion 32 is absorbed by the second portion 32 because of the visible light absorbability of the functional content 32*b*. Thus, it can be effectively avoided that the visible light from the sun directly enters the room without changing its traveling direction. Namely, from the viewpoint of anti-glare effect, the light shielding function for restricting direct light into the room can be offered, whereby it can be prevented that a person in the room feels dazzled. Alternatively, when the functional content 32*b* has a function for absorbing heat rays, as shown in FIG. 3, most of heat rays of the sunlight beam L34 having entered the second portion 32 is absorbed by the second portion 32 because of the heat-ray absorbability of the functional content 32*b*. Thus, it can be effectively avoided that the heat rays from the sun enter the room, i.e., the heat shielding function can be exerted. Also due to the light shielding function and the heat shielding function of the second portion 32, the use of electric appliances such as an air conditioner can be restrained, whereby a lighting tool and so on, energy can be saved and $CO_2$ can be reduced.

In addition, when the second portion 32 contains only a little amount of the functional content 32*b* functioning as an absorbent or does not contain it at all, light, which has entered the second portion 32 without reflecting on the interface between the first portion 31 and the second portion 32, passes through the second portion 32 to pass through the light control member 20. As shown in FIG. 1, such light beam L13, which takes a light path similar to that of direct light, is shielded by the slats 60 of the shade 50. Thus, it can be remarkably effectively prevented that such light impairs the light shielding function for anti-glare effect.

According to the aforementioned embodiment, there is installed, in the upper part of the opening 1, the light control member 20 capable of guiding light up to a position distant from the opening 1 inside the area to be daylighted ("inside of the room" in the illustrated example). The light control member 20 that offers the excellent daylighting function is formed to have a sheet-like shape. Thus, there is no portion that projects toward the area to be daylighted. Thus, disfiguring of a peripheral area of the opening 1 can be effectively avoided. In addition, the sheet-like light control member 20 including no projection is not so subjected to a restriction related to an installation place that the light control member 20 can be installed various openings 1. Namely, the daylighting system 10 according to this embodiment can be applied to various openings 1, without disfiguring the peripheral area of each opening 1.

In addition, the shade 50 is disposed oppositely to at least a part of the opening 1, which is below the part where the light control member 20 is disposed. The shade 50 can offer the light shielding function, the heat shielding function, the privacy function and so on. Namely, the daylighting system 10 including the light shielding member 20 and the shade 50 can exert various favorable functions upon light entering through the opening 1.

In addition, according to this embodiment, the shade 50 is also located on a position facing the light control member 20. Thus, when observed from the area to be daylighted, i.e., when observed from the inside of the room in the above example, the shade 50 hides the light control member 20 offering the daylighting function, so that it can be significantly effectively avoided that the peripheral area of the opening 1 is disfigured or impaired in terms of unified fashion. Moreover, by coloring the slats 60 of the shade 50, for example, even a design property of the peripheral area of the opening 1 can be improved.

Further, in the plane along both the normal direction nd to the light control member 20 and the second direction d2 which is the arrangement direction of the first and second portions 31, 32, the light control member 20 can control a traveling direction of incident light, such that the angular range $\theta_O$ including the outgoing direction of the light going out from the light control member 20, the light having changed its traveling direction in the light control member 20 and passed through the light control member 20, is smaller than the angular range $\theta_i$ including the incident direction of the light incident on the light control member 20. Thus, even when the slats 60 of the shade 50 are inclined so as to exert the light shielding function for an anti-glare effect, since light transmits through the light control member 20 such that its outgoing direction is narrowed down into a small angular range, the light can pass through between the slats 60 to enter the area to be daylighted. Namely, due to the combination of the light control member 20 and the shade 50 according to this embodiment, the light shielding function for shielding direct light in terms of an anti-glare effect can be offered, while the daylighting function can be simultaneously achieved.

The aforementioned embodiment can be variously modified. Herebelow, one modification example is described with reference to the drawings. In the below description and the drawings used in the below description, a component that can be configured similarly to the above embodiment is indicated by the same reference number as that of the above embodiment, and overlapped description is omitted.

Figure 5:
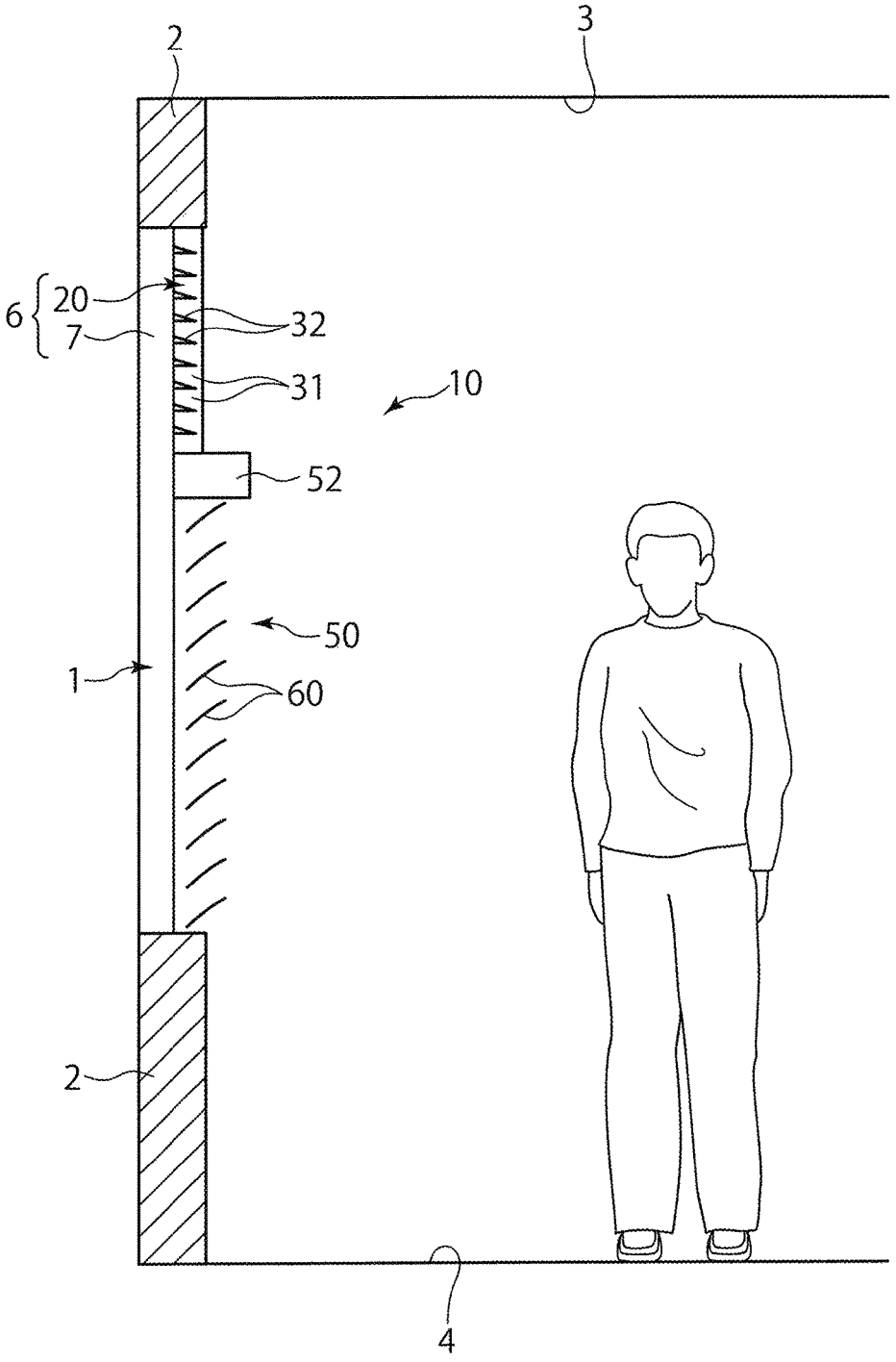
FIG. 5 is a side view showing a modification example of the daylighting system, correspondingly to FIG. 1.

For example, in the aforementioned embodiment, the shade 50 is located to cover not only an area opposed to a part of the opening 1, the part being below the part where the light control member 20 is disposed, but also an are opposed to the light control member 20. However, not limited thereto, as shown in FIG. 5, the shade 50 may be located only on the area opposed to the part of the opening 1, which is below the part where the light control member 20 is disposed. Also in the example shown in FIG. 5, the light control member 20 is formed to have a sheet-like shape, and thus does not have any portion projecting toward the area to be daylighted. Thus, the lighting system 10 can be applied to various openings 1, while effectively avoiding disfiguring of the peripheral area of each opening 1.

In addition, in the aforementioned embodiment, although the daylighting system 10 is applied to the opening 1 formed in the wall 2 of the building, the present invention is not limited thereto. For example, the daylighting system 10 can be applied to an opening formed in a mobile object such as an automobile, an electric train, an airplane, a vehicle, etc.

Further, as shown by the two-dot chain lines in FIG. 1, there may be further provided an openable and closable light shielding means 65 such as a curtain, which is movably supported in the right and left direction or the up and down direction, at a position between the light control member 20 and the shade 50. The above lighting system 10 can let in sunlight, while shielding direct light by the shade 50. Owing to the use of the light shielding means 65, while the shade 50 offers the light shielding function for an anti-glare effect, whether the daylighting function is exerted by the daylighting system 10 or not can be controlled.

Furthermore, in the aforementioned embodiment, although the daylighting function for letting in sunlight in a desired direction can be achieved by bending a traveling direction of the sunlight by the reflection on the interface between the first portion 31 and the second portion 32 of the light control member 20, the present invention is not limited to this example. The light control member 20 may have a so-called prism surface which bends a traveling direction of light by reflection or refraction, so as to introduce the light.

Still furthermore, the light control member 20 may further have a functional layer expected to offer various functions, in addition to the first portions 31 and the second portions 32. For example, the light control member 20 may be further provided with a hard coat layer having abrasion resistance, as a layer closest to the inside of the room.

Yet furthermore, in the aforementioned embodiment, the inclinations of all the slats 60 included in the shade 50 are operated in parallel with one another by the ladder code 56. However, for example, by operating slats located on a position opposed to the light control member 20 and slats other than these slats by means of separate ladder codes, the inclinations of the slats 60 in the area opposed to the light control member 20 and the inclinations of the slats 60 in the other area may be independently adjusted.

The invention claimed is:

1. A daylighting system comprising:

a sheet-like light control member disposed on at least an upper part of a daylighting opening, the light control member being configured to change upward a traveling direction of incident light and allow the incident light to pass therethrough;

a shade disposed oppositely with respect to at least a part of the daylighting opening that is below the upper part of the daylighting opening where the light control member is disposed; and a window member installed on the daylighting opening, the window member supporting the light control member, wherein the light control member includes transparent first portions that extend in a first direction that is nonparallel with respect to an up-and-down direction and that are arranged in a second direction that is nonparallel with respect to the first direction, and second portions that are arranged along the second direction alternately with the first portions, the second portions having a refractive index that is different from that of the first portions, and wherein in a plane along a normal direction to the light control member and the second direction, an angular range including an outgoing direction of light going out from the light control member, the light having been totally reflected on an interface between the first portions and the second portions and passed through the light control member, is smaller than an angular range including an incident direction of the light incident on the light control member.

2. The daylighting system according to claim 1, wherein the shade is configured to be oppositely disposed with respect to the light control member.

3. The daylighting system according to claim 1, wherein in a plane along a normal direction to the light control member and the second direction, an angular range including an outgoing direction of light going out from the light control member, the light having been reflected on an interface between the first portion and the second portion and passed through the light control member, is smaller than an angular range including an incident direction of the light incident on the light control member.

4. The daylighting system according to claim 1, wherein in a plane along a normal direction to the light control member and the second direction, an angle defined by an interface between each second portion and the first portion adjacent to the second portion from above, relative to the normal direction to the light control member, decreases from an incident side toward an outgoing side.

5. An object comprising the daylighting system according to claim 1.

6. The daylighting system according to claim 1, wherein the window member includes window members, and the light control member is located between the window members.

7. The daylighting system according to claim 1, wherein each of the second portions includes a first side surface facing one side in the second direction and a second side surface facing the other side in the second direction, the first side surface is formed as a polygonal surface, and includes a steeply inclined surface and a mildly inclined surface, and an angle defined by the steeply inclined surface relative to the normal direction to the light control member is larger than an angle defined by the mildly inclined surface relative to the normal direction to the light control member.

* * * * *